US005098364A

United States Patent [19]

Schilling

[11] Patent Number: 5,098,364

[45] Date of Patent: Mar. 24, 1992

[54] WASTE CONTAINER LINER AND METHOD FOR MANUFACTURING SAME

[75] Inventor: Michael R. Schilling, Clinton, La.

[73] Assignee: Pactec, Inc., Clinton, La.

[21] Appl. No.: 748,081

[22] Filed: Aug. 21, 1991

Related U.S. Application Data

[62] Division of Ser. No. 500,020, Mar. 26, 1990.

[51] Int. Cl.[5] ..... B31B 21/14; B31B 21/64

[52] U.S. Cl. ..... 493/200; 493/195; 493/287; 493/293

[58] Field of Search ..... 493/194, 195, 199, 200, 493/211, 287, 293

[56] References Cited

U.S. PATENT DOCUMENTS

| | | | |
|---|---|---|---|
| 977,698 | 12/1910 | Barksdale . | |
| 2,215,689 | 9/1940 | Dickson | 206/8 |
| 2,216,527 | 10/1940 | Weiss et al. | 229/14 |
| 2,524,584 | 10/1950 | Zehr | 154/116 |
| 2,574,345 | 11/1951 | Montgomery | 150/52 |
| 2,683,262 | 7/1954 | Foss | 2/2 |
| 2,712,797 | 7/1955 | Woehrle et al. | 105/367 |
| 2,998,340 | 8/1961 | Conway et al. | 154/116 |
| 3,069,978 | 12/1962 | Hoeppner | 493/194 |
| 3,167,209 | 1/1965 | Jones | 220/63 |
| 3,219,240 | 11/1965 | Campbell, Jr. | 222/183 |
| 3,306,328 | 2/1967 | Markus | 150/38 |
| 3,349,991 | 10/1967 | Kessler | 493/194 |
| 3,422,867 | 1/1969 | Wu | 150/3 |
| 3,459,357 | 8/1969 | Egger et al. | 229/37 |
| 3,468,102 | 9/1969 | Farrar et al. | 53/385 |
| 3,539,360 | 11/1970 | Wood | 99/171 |
| 3,570,751 | 3/1971 | Trewella | 229/66 |
| 3,617,418 | 11/1971 | Miller | 156/227 |
| 3,888,163 | 6/1975 | Watanabe | 93/36.01 |
| 4,385,953 | 5/1983 | Beck | 156/200 |
| 4,461,402 | 7/1984 | Fell et al. | 222/105 |
| 4,570,820 | 2/1986 | Murphy | 221/34 |
| 4,624,654 | 11/1986 | Boyd et al. | 493/194 |
| 4,671,733 | 6/1987 | Krein | 414/786 |
| 4,754,914 | 7/1988 | Wischusen, III | 229/87 F |
| 4,871,046 | 10/1989 | Turner | 181/131 |
| 5,007,744 | 4/1991 | Scarberry et al. | 493/194 |

FOREIGN PATENT DOCUMENTS

| | | |
|---|---|---|
| 0294087 | 12/1988 | European Pat. Off. . |
| 1085853 | 10/1967 | United Kingdom . |

*Primary Examiner*—William E. Terrell

*Attorney, Agent, or Firm*—Robert C. Tucker; William David Kiesel

[57] ABSTRACT

A method for manufacturing a liner for a waste container is provided, comprising the steps of extruding a flexible envelope, the envelope having ends; flattening the envelope so as to form a top side and a bottom side; cutting a lengthwise slit in the top side of the envelope substantially along the centerline of the envelope; sealing the ends of the envelope; folding the envelope along the centerline; and rolling one end toward the other to form a rolled bundle. A waste container liner may be formed by this process, comprising a flexible envelope including a top side; a bottom side; first and second ends; gusseted side panels connecting the top side and the bottom side; a lengthwise slit in the top side between the first and second ends substantially along the centerline of the envelope; and wherein the top and bottom sides are sealed together at the first and second ends.

6 Claims, 2 Drawing Sheets

WASTE CONTAINER LINER AND METHOD FOR MANUFACTURING SAME

This is a division of application Ser. No. 07/500,020, filed on Mar. 26, 1990 pending.

BACKGROUND OF THE INVENTION

1. Field of the Invention

This invention relates generally to liners which are used in waste containers to prevent contact between the waste and the container and to encapsulate the waste and, more particularly, to such liners which are used to line large waste containers, such as roll-off containers.

2. Prior Art

As more and more public attention is given to the disposal of all types of waste, more effort is being made to assure that the waste disposal process works more efficiently and minimizes ecological damage. Waste is generally hauled in large containers, such as roll-off boxes, dump trailers, rail gondolas and the like. Prudent management practices now dictate that waste containers be lined with a disposable liner which is disposed or with the waste, thus reducing or eliminating contamination of the waste container by a particular load of waste material. Prior art liners resemble very large plastic bags which fit inside the containers.

Current commercially available waste container liners are packaged in a bundle formed by multiple rectangular folds. In order to line a waste container, personnel must unpackage the folded prior art liner, unfold the liner and place the liner in the waste container. Due to the large size of the containers used, the installation process for prior art liners is cumbersome and often difficult for one person to accomplish. Also, current liner designs expose liner construction seams (often heat-sealed or sewn seams) to stress from the material filling the liners, making seam failure a major concern of waste haulers.

SUMMARY OF THE INVENTION

Therefore, it is an object of this invention to provide a waste container liner which can be quickly and easily installed in a waste container.

It is another object of this invention to provide a waste container liner which does not expose construction seams to load stresses when in place within a waste container.

It is a further object of this invention to provide a method for manufacturing a waste container liner such that a liner is produced which meets any one or all of the above objects.

Accordingly, a method for manufacturing a liner for a waste container is provided, comprising the steps of extruding a flexible envelope, the envelope having ends; flattening the envelope so as to form a top side and a bottom side; cutting a lengthwise slit in the top side of the envelope substantially along the centerline of the envelope; sealing the ends of the envelope; folding the envelope along the centerline; and rolling one end toward the other to form a rolled bundle. A waste container liner may be formed by this process, comprising a flexible envelope including a top side; a bottom side; first and second ends; gusseted side panel connecting the top side and the bottom side; a lengthwise slit in the top side between the first and second ends substantially along the centerline of the envelope; and wherein the top and bottom sides are sealed together at the first and second ends.

The liner produced in accordance with the invention can be installed by simply unrolling the liner within the container and opening it outward from the slit. Installation can be quickly and easily accomplished by one person.

DETAILED DESCRIPTION OF PREFERRED EMBODIMENTS OF THE INVENTION

Figure 5:
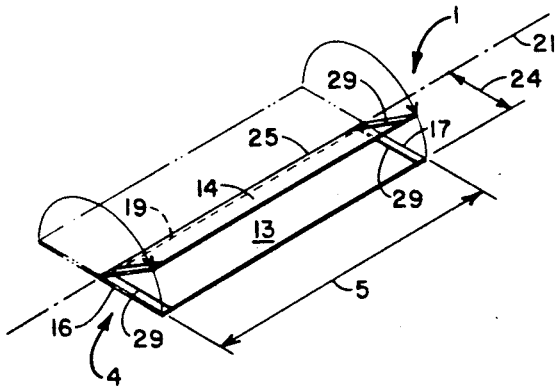
FIG. 5 is a perspective view of a step in the manufacturing process of the invention.
Figure 6:
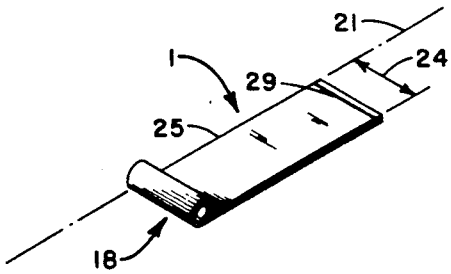
FIG. 6 is a perspective view of a step in the manufacturing process of the invention.
Figure 7:
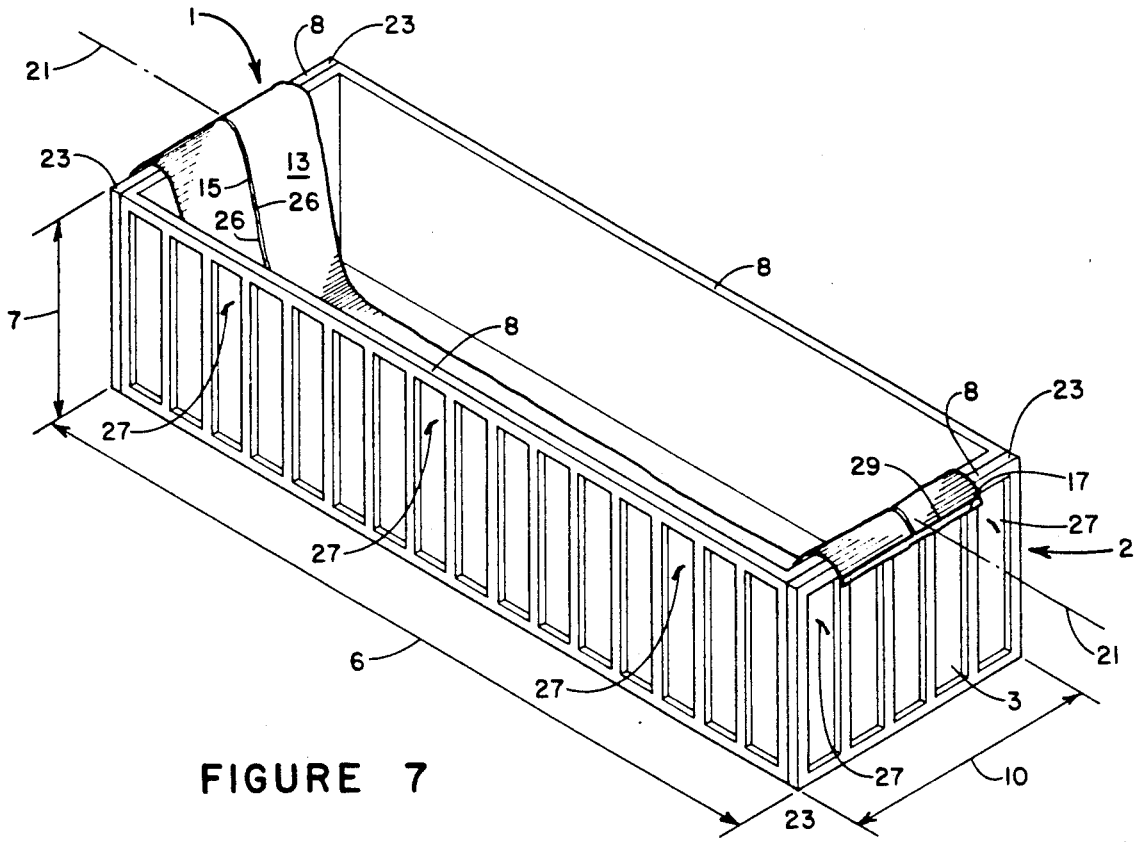
FIG. 7 is a perspective view of an embodiment of the liner unrolled in a roll-off box.
Figure 8:
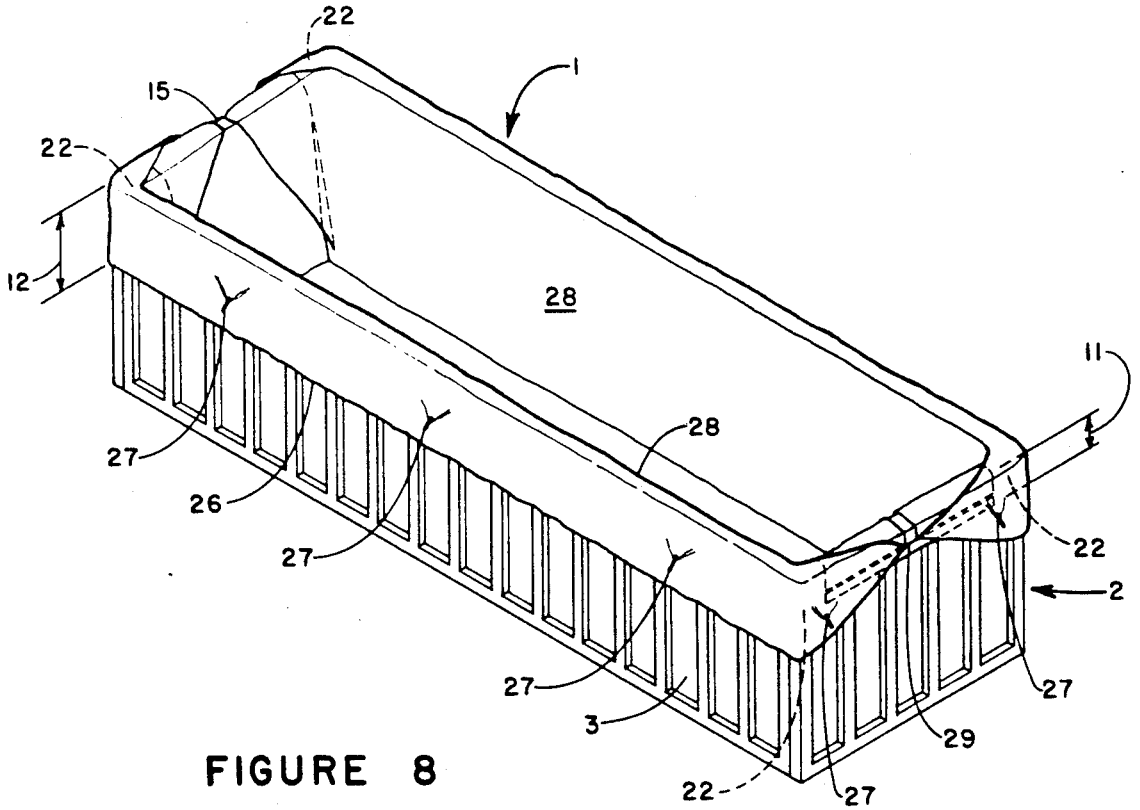
FIG. 8 is a perspective view of the embodiment of the liner shown in FIG. 7 after the liner is fully installed in the roll-off box.

The invention generally comprises a waste container liner 1. Liner 1 is usually constructed of a polymeric material, such as polyethylene, although any desirable flexible material may be used to suit the type of waste being handled. The liner 1 is installed in a waste container 2, such as a roll-off box 3, and is disposable with the waste which is placed within the box 3 and liner 1. FIGS. 7–8 show the installation of liner 1 in box 3, and FIG. 1–6 show the process by which liner 1 is manufactured. While a liner 1 is shown for one type of waste container 2, various sizes of liners 1 can be manufactured for other types of waste containers 2, such as dump trailers, rail gondolas and the like. The unique construction of liner 1 enables quick installation by one person without significant contact between the person and the interior of the waste container 2.

Figure 1:
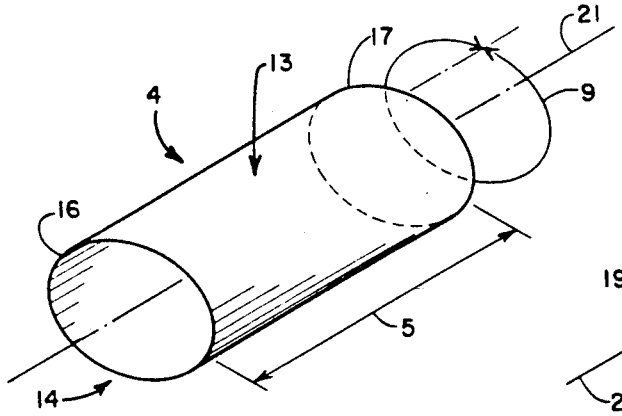
FIG. 1 is a perspective view of a step in the manufacturing process of the invention.

The design of liner 1 can be more readily understood by examining the method by which it is manufactured. As shown in FIG. 1, a flexible envelope 4 of liner material is extruded. Sufficient length 5 must be allowed such that liner 1 may be opened so as to loosely cover the interior of box 3 and extend over edges 8 a sufficient distance to hold liner 1 in place (see FIG. 8). Envelope 4 should have a length 5 equal to the total of the length 6 of box 3 plus twice the depth 7 of box 3, plus an allowance for length overhang 11 (see FIGS. 7 and 8). Likewise, the circumference 9 of envelope 4 should be total of the width 10 or the box 3 plus twice the depth 7 of the box, plus an allowance for width overhang 12. For example, a roll-off box 3 having interior dimensions of 22 feet (length 6) by 8 feet (width 10) by 4.5 feet (depth 7), requiring a length overhang 11 of 1 foot on each end and a width overhang 12 of 2 feet on each side, will require an envelope 4 approximately 33 feet long (22'+4.5'+4.5'+1'+1'), and 21 feet in circumference (8'+4.5'+4.5'+2'+2').

Figure 3:
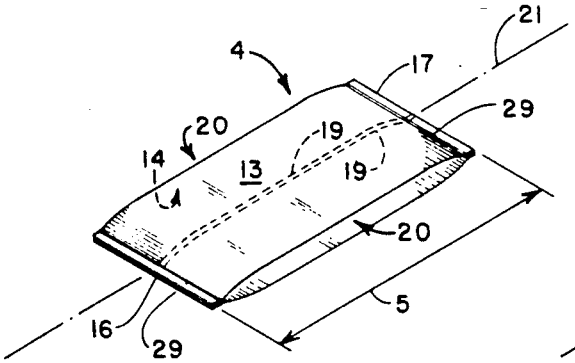
FIG. 3 is a perspective view of a step in the manufacturing process of the invention.
Figure 4:
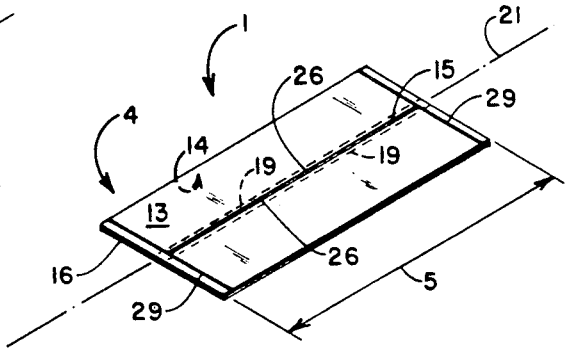
FIG. 4 is a perspective view of a step in the manufacturing process of the invention.

Once envelope 4 is extruded having a top side 13 and a bottom side 14, it is flattened and a lengthwise slit 15 is cut in top side 13 substantially along centerline 21 of envelope 4, as shown in FIG. 4. As will be seen, slit 15 allows liner 1 to be opened outward from the center of container 2. Slit 15 also allows the installer to easily center liner 1 in container 2. First end 16 and second end 17 of envelope 4 are sealed by means such as heat sealing along seams 29, as shown in FIGS. 3 and 4. The liner 1 is then rolled into a rolled bundle 18, as shown in FIG. 6.

Figure 2:
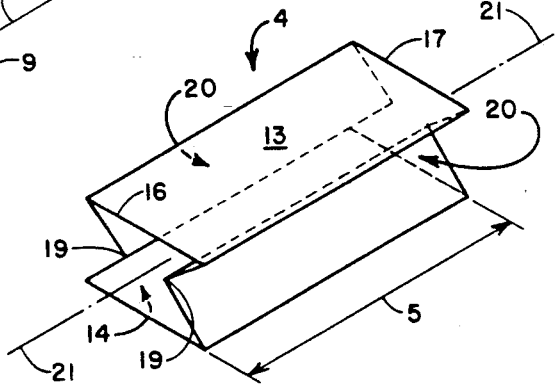
FIG. 2 is a perspective view of a step in the manufacturing process of the invention.

It is preferable that, during the manufacturing process, a pair of gussets 19 be formed in the sides 20 of envelope 4, as shown in FIG. 2. Gussets 19 allow the sides 20 of envelope 4 to be folded inward for easy handling, yet be unfolded easily for installation. It is preferred that gussets 19 extend inward substantially to centerline 21 of envelope 4, minimizing the width of rolled bundle 18. Also, when envelope 4 is gusseted and ends 16,17 are sealed, corner pockets 22 are formed in liner 1 when it is expanded for installation in container 2. As shown in FIG. 8, corner pockets 22 fit over corners 23 of container 2 and serve to hold liner 1 in place and further facilitate installation. As shown in FIG. 5, an additional manufacturing step of folding the flattened liner 1 along a centerfold 25 (along centerline 21) allows for further reduction in the width 24 of rolled bundle 18. In the example described above with an envelope circumference 9 of 21 feet, if gussets 19 are folded inward to centerline 21 and, if flattened envelope 9 is folded in half before rolling, rolled bundle 18 has a width 24 of only 2.625 feet. Rolled bundle 18 can thus be easily stored for later use by waste hauling personnel.

Installation of a liner 1 is safe, simple and efficient. Rolled bundle 18 is removed from storage and unrolled, either next to or inside container 2, and centerfold 25 is unfolded, with slit 15 facing upward. Slit 15 is centered in container 2, as shown in FIG. 7. Once this is accomplished, the installer simply pulls the edges 26 of slit 15 upward and outward, expanding gusseted side panels 28, and securing edges 26 over edge 8 of box 3 to the desired overhangs 11,12, with corner pockets 22 in place over corners 23. When installation hooks 27 are provided on box 3, the installer may hook the perimeter of liner 1 on hooks 27 by puncturing liner 1 at the appropriate points, as shown.

A liner 1 for a waste container 2 is thus provided which is manufactured in a compact, rolled bundle 18, and which is easily stored. Installation is quickly and easily accomplished. Other embodiments of the invention will occur to those skilled in the art, and are intended to be included in the scope and spirit of the following claims.

I claim:

1. A method for manufacturing a liner for a waste container, comprising the steps of:

a. extruding a flexible envelope, said envelope having ends;

b. flattening said envelope so as to form a top side and a bottom side;

c. cutting a lengthwise slit in said top side of said envelope substantially along the centerline of said envelope;

d. sealing said ends of said envelope;

e. rolling one said end toward the other to form a rolled bundle.

2. A method for manufacturing a liner for a waste container according to claim 1, further comprising the step of forming a pair of lengthwise gussets between said top side and said bottom side of said envelope.

3. A method for manufacturing a liner for a waste container according to claim 2, wherein said gussets are formed so as to extend to the centerline of said envelope when said envelope is flattened.

4. A method for manufacturing a liner for a waste container according to claim 1, further comprising the step of folding said envelope substantially along said centerline prior to said step of rolling one said end toward the other.

5. A method for manufacturing a liner for a waste container according to claim 2, further comprising the step of folding said envelope substantially along said centerline prior to said step of rolling one said end toward the other.

6. A method for manufacturing a liner for a waste container according to claim 3, further comprising the step of folding said envelope substantially along said centerline prior to said step of rolling one said end toward the other.

* * * * *